US009268307B2

(12) United States Patent
Conus et al.

(10) Patent No.: US 9,268,307 B2
(45) Date of Patent: Feb. 23, 2016

(54) POLYGONAL BALANCE SPRING FOR A RESONATOR FOR A TIMEPIECE

(71) Applicant: ETA SA Manufacture Horlogere Suisse, Grenchen (CH)

(72) Inventors: Thierry Conus, Lengnau (CH); Jean-Luc Helfer, Le Landeron (CH); Laurent Jeanneret, Villers le Lac (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 14/553,298

(22) Filed: Nov. 25, 2014

(65) Prior Publication Data

US 2015/0168916 A1 Jun. 18, 2015

(30) Foreign Application Priority Data

Dec. 16, 2013 (EP) ..... 13197318

(51) Int. Cl.
*G04B 17/06* (2006.01)

(52) U.S. Cl.
CPC ..... *G04B 17/063* (2013.01); *G04B 17/066* (2013.01)

(58) Field of Classification Search
CPC ..... G04B 17/06; G04B 17/066; G04B 17/20; G04B 17/227
USPC ..... 368/69, 175
See application file for complete search history.

(56) References Cited

U.S. PATENT DOCUMENTS

| | | | | |
|---|---|---|---|---|
| 570,394 | A * | 10/1896 | Griscom | 368/175 |
| 8,764,281 | B2 * | 7/2014 | Zaugg | 368/175 |
| 2009/0016173 | A1 * | 1/2009 | Hessler et al. | 368/140 |
| 2010/0027382 | A1 * | 2/2010 | Daout et al. | 368/175 |
| 2012/0008468 | A1 | 1/2012 | Bossart et al. | |
| 2012/0075963 | A1 * | 3/2012 | Zaugg | 368/127 |
| 2012/0106303 | A1 * | 5/2012 | Von Gunten et al. | 368/175 |
| 2014/0022873 | A1 * | 1/2014 | Ching | 368/175 |

FOREIGN PATENT DOCUMENTS

| | | | |
|---|---|---|---|
| EP | 2 233 989 | A1 | 9/2010 |
| EP | 2 407 831 | A1 | 1/2012 |
| FR | 1546209 | | 11/1968 |

OTHER PUBLICATIONS

European Search Report issued Jul. 30, 2014, in European Application No. 13197318.2 filed Dec. 16, 2013 (with English Translation).

* cited by examiner

*Primary Examiner* — Vit W Miska
(74) *Attorney, Agent, or Firm* — Oblon, McClelland, Maier & Neustadt, L.L.P.

(57) ABSTRACT

The invention relates to a balance spring for a resonator of a timepiece including a strip coiled on itself into several coils. According to the invention, the strip is formed by a series of prismatic portions integral with each other wherein one of the two opposite faces is formed by a series of rectangular portions integral with each other so as to form a polygonal spring.

20 Claims, 4 Drawing Sheets

POLYGONAL BALANCE SPRING FOR A RESONATOR FOR A TIMEPIECE

This application claims priority from European Patent Application No. 13197318.2 filed Dec. 16, 2013 the entire disclosure of which is incorporated herein by reference.

FIELD OF THE INVENTION

The invention relates to a polygonal balance spring intended to reduce the risk of coils sticking to each other in order to improve the working of a resonator in which said spring is used.

BACKGROUND OF THE INVENTION

It is usual, in horology, to form balance springs wherein the strip is coiled substantially in an Archimedean spiral trajectory. However, since new materials such as, for example, crystalline silicon, have been used in horology, it has been observed that sticking may occur between the coils.

SUMMARY OF THE INVENTION

It is an object of the present invention to overcome all or part of the aforementioned drawbacks, by proposing an alternative to the conventional balance spring which prevents coils sticking to each other.

To this end, according to a first embodiment, the invention relates to a balance spring for a resonator for a timepiece, including a solid strip coiled around itself in several coils, characterized in that at least one part of the strip is formed by a series of prismatic portions integral with each other so as to form a polygonal spring.

According to a second embodiment, the invention relates to a balance spring for a resonator for a timepiece including a solid strip coiled around itself in several coils, characterized in that the two opposite faces of each coil facing at least one other coil, are asymmetrical and in that at least one part of said at least two opposite faces is formed by a series of rectangular portions integral with each other so as to form a polygonal balance spring.

Advantageously according to the two embodiments of the invention, the polygonal balance spring thereby obtained makes it possible geometrically to reduce the risk of sticking between the coils, or strictly to limit the contact surface between coils at the junction surface between two prismatic portions of the strip or between two rectangular portions of the surface of a coil.

In accordance with other advantageous variants of the invention:

- according to the first embodiment, at least two adjacent prismatic portions form an obtuse angle between them;
- according to the first embodiment, the lengths of the prismatic portions forming said balance spring are not constant;
- according to the first embodiment, the lengths of the prismatic portions decrease continuously from the first prismatic portion of the inner coil to the last prismatic portion of the outer coil of said balance spring;
- according to the second embodiment, the lengths of the rectangular portions forming said one of said at least two opposite faces, are not constant;
- according to the second embodiment, the other of said at least two opposite faces is formed by a single spiral-shaped surface;

- at least one part of the other of said at least two opposite faces is formed by a series of rectangular portions integral with each other;
- according to the second embodiment, the lengths of the rectangular portions forming the other of said at least two opposite faces, are not constant;
- according to the second embodiment, the lengths of the rectangular portions of one or other of said at least two opposite faces increase continuously from the first rectangular portion of the inner coil to the last rectangular portion of the outer coil of said balance spring;
- according to the two embodiments, the thickness of the strip is thickened locally to increase its rigidity;
- according to the two embodiments, the inner coil is integral with a collet arranged to be secured to an arbor;
- according to the two embodiments, the balance spring is in one piece;
- according to the two embodiments, the balance spring is formed of a material including silicon.

Finally, the invention also relates to a timepiece, characterized in that it includes at least one balance spring according to any of the preceding variants.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

The present invention relates to a balance spring intended for the field of horology. More specifically, the balance spring is intended to be mounted in a timepiece, for example together with a balance to form a sprung balance resonator forming the regulating member of the timepiece.

As explained above, it has been observed that the use of crystalline silicon springs may cause sticking between the coils. Indeed, the heights H, i.e. the vertical portions, of the coils facing each other are so smooth that adherence can result simply from two coils moving closer together, for example when the timepiece experiences a shock. This adherence may be further increased by contamination of the spring with dirt or lubricant during manufacture or wear.

Spring 1, 11, 21, 31, 41, 51, 61, 71 according to the invention includes a solid strip 3, 13, 23, 33, 43, 53, 63, 73, i.e. with no recesses or holes, having a length L, a height H and a thickness E. Strip 3, 13, 23, 43, 53, 63, 73 is coiled around itself into several coils $S_1$, $S_2$, $S'_1$, $S'_2$, $S_3$, $S_{ext}$, $S_{int}$.

Advantageously according to a first embodiment of the invention, at least one part of strip 3, 23, 43, 63, is formed by a series of prismatic portions $P_1$, $P_2$, $P_x$, $P'_x$, $P_y$, $P'_y$, $P_z$ integral with each other so as to obtain a polygonal spring 1, 21, 41, 61.

Figure 1:
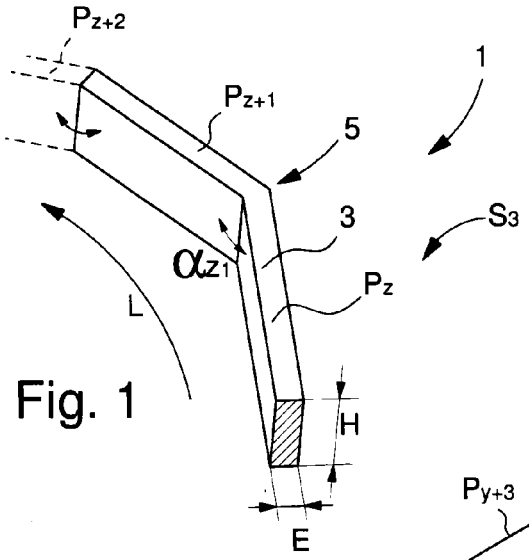
FIG. 1 is a schematic view of two adjacent prismatic portions according to a first embodiment of the invention.

The polygonal spring 1, 21, 41, 61 thereby obtained geometrically reduces the risk of sticking between the coils $S_1$, $S_2$, $S'_1$, $S'_2$, $S_3$, $S_{ext}$, $S_{int}$, or strictly limits the contact surface between the coils $S_1$, $S_2$, $S'_1$, $S'_2$, $S_3$, $S_{ext}$, $S_{int}$, at the junction surface between two prismatic portions $P_1$, $P_2$, $P_x$, $P'_x$, $P_y$, $P'_y$, $P_z$. Indeed, each junction forms an angle $\alpha$ between each portion P like, for example in FIG. 1, the angle $\alpha_{z1}$ between portion $P_z$ and portion $P_{z+1}$. It is thus understood that coil $S_3$ has, at each junction, a contact surface 5 which is substantially vertical and parallel to height H which faces the immediately consecutive coil.

As explained above, since strip 3, 23, 43, 63 has to be coiled on itself, at least two adjacent prismatic portions $P_1$, $P_2$, $P_x$, $P'_x$, $P_y$, $P_z$ form, preferably according to the invention, an obtuse angle $\alpha$, i.e. an angle $\alpha$ of less than 180° but more than 90°. Indeed, portions $P_1$, $P_2$, $P_x$, $P_y$, $P_z$ do not all need to be strictly non-aligned and some consecutive portions $P_1$, $P_2$, $P_x$, $P_y$, $P_z$ may be usefully be joined at an angle $\alpha$, for example, equal to 180°.

Figure 5:
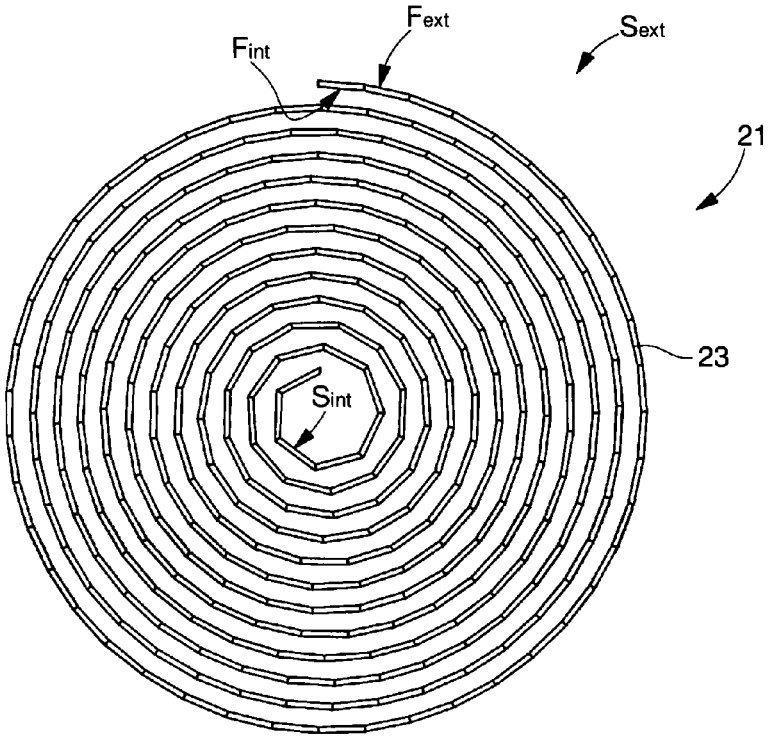
FIGS. 5 to 6 are top views of alternatives of a balance spring according to a first embodiment of the invention.

It is of course also possible for each prismatic portion $P_1$, $P_2$, $P_x$, $P'_x$, $P_y$, $P'_y$, $P_z$ to be joined to at least one other adjacent prismatic portion at an obtuse angle. Such an example is illustrated in FIGS. 2 and 5.

Figure 2:
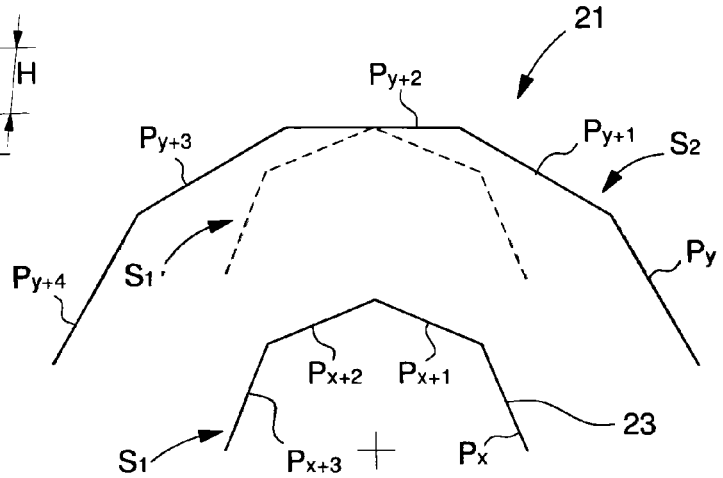
FIGS. 2 and 3 are partial top views of two examples of a balance spring according to a first embodiment of the invention.

FIG. 2 is a partially view of a balance spring 21 formed by a single strip 23 wherein two successive coils $S_1$, $S_2$ are respectively formed by portions $P_x$, $P_{x+1}$, $P_{x+2}$, $P_{x+3}$ and portions $P_y$, $P_{y+1}$, $P_{y+2}$, $P_{y+3}$, $P_{y+4}$. Coil $S_1$ in a solid line is referenced $S_1$, in a dotted line to illustrate its displacement during a shock. It is immediately apparent that, unlike a conventional balance spring, in the event of a shock, only the junctions between portions $P_x$, $P_{x+1}$, $P_{x+2}$, $P_{x+3}$ will enter into contact respectively with portions $P_y$, $P_{y+1}$, $P_{y+2}$, $P_{y+3}$, $P_{y+4}$, etc. of the immediately consecutive coil $S_2$.

To increase the chances of the junctions between portions $P_1$, $P_2$, $P_x$, $P'_x$, $P_y$, $P'_y$, $P_z$ only touching the immediately consecutive coil, the lengths of prismatic portions $P_1$, $P_2$, $P_x$, $P'_x$, $P_y$, $P'_y$, $P_z$ forming the inner coil of said spring must be greater than the lengths of the prismatic portions $P_1$, $P_2$, $P_x$, $P'_x$, $P_y$, $P'_y$, $P_z$ forming the outer coil of said spring.

Figure 6:
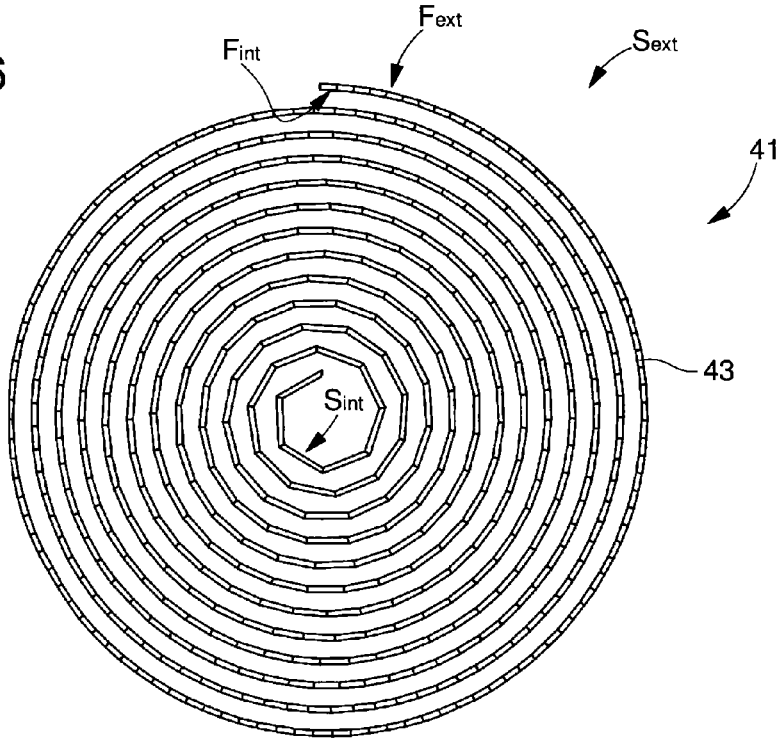

However, in order to totally prevent contact other than at the junctions, the lengths of prismatic portions $P_1$, $P_2$, $P_x$, $P'_x$, $P_y$, $P'_y$, $P_z$ decrease continuously from the first prismatic portion of the inner coil to the last prismatic portion of the outer coil of said spring regardless of the state of winding of the spring, i.e. regardless of the contraction or the expansion of the spring. Such an example is illustrated in FIGS. 3 and 6.

Figure 3:
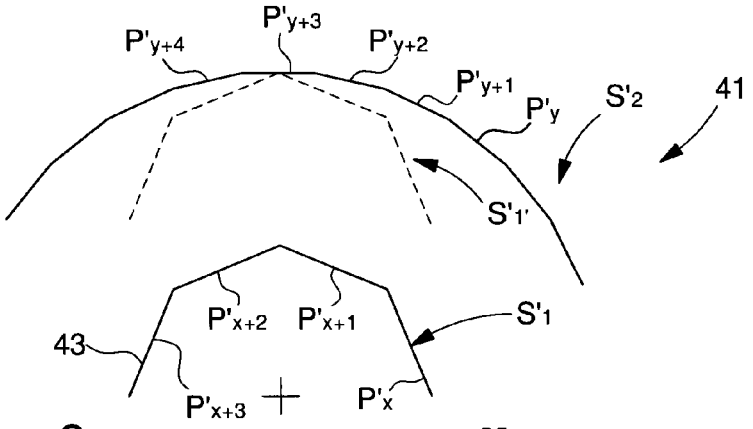

FIG. 3 is a partial view of a balance spring 41 formed by a single strip 43 wherein two successive coils $S'_2$ are respectively formed by portions $P_x$, $P_{x+1}$, $P'_{x+2}$, $P_{x+3}$ and portions $P'_y$, $P_{y+1}$, $P'_{y+2}$, $P'_{y+3}$, $P'_{y+4}$. Coil $S'_1$ in a solid line is referenced $S'_1$, in a dotted line to illustrate its displacement during a shock. It is thus immediately apparent that, in the event of a shock, geometrically, only the junctions of coil $S'_1$ between portions $P'_x$, $P'_{x+1}$, $P_{x+2}$, $P'_{x+3}$ are capable of entering into contact respectively with portions $P'_y$, $P'_{y+1}$, $P'_{y+2}$, $P'_{y+3}$, $P'_{y+4}$, etc. of the immediately consecutive coil $S'_2$.

In the examples of FIGS. 1 to 5, the opposite faces $F_{int}$, $F_{ext}$ of each prismatic portion of a coil facing at least one other coil, are preferably symmetrical, i.e. parallel. However, the opposite faces $F_{int}$, $F_{ext}$ of each prismatic portion of a coil could also be asymmetrical so that the section formed by height H over thickness E is continually variable, i.e. it increases and/or decreases, permanently on each prismatic portion. Thus, the asymmetry between the two opposite faces $F_{int}$, $F_{ext}$ of each prismatic portion would result in a continuous variation in thickness E over the length L of each prismatic portion. It is thus understood that the two polygonal bases of the prismatic portions could be, by way of example, hexagonal or trapezoidal.

Advantageously according to a second embodiment of the invention, the two opposite faces $F_{int}$, $F_{ext}$ of each coil facing at least one other coil, are asymmetrical, as illustrated in the examples of FIGS. 7 to 10 showing top views. It is thus understood that the section formed by the height H over thickness E is continuously variable, i.e. permanently increases and/or decreases over the length of the strip of the balance spring. Indeed, the asymmetry between the two opposite faces $F_{int}$, $F_{ext}$ results in a continuous variation in thickness E over the length of the strip of the balance spring.

Preferably, at least one part of one of said at least two opposite faces $F_{int}$, $F_{ext}$ is formed by a series of rectangular portions integral with each other so as to form a polygonal spring 11, 31, 51, 71.

The polygonal spring 11, 31, 51, 71 thereby obtained makes it possible geometrically to decrease the risk of sticking between the coils comprised between inner coil $S_{int}$ and outer coil $S_{ext}$, and even strictly to limit the contact surfaces between the coils at the junction surface (symbolised by a dot in FIGS. 7 to 10) between two rectangular portions. Indeed, as in the first embodiment, each junction forms an angle $\alpha$ between each rectangular portion. It is therefore understood that the inner coil $S_{int}$ has, at each junction, a contact surface which is substantially vertical and parallel to the height H which faces the immediately consecutive coil.

As explained above, as the strip 13, 33, 53, 73 has to be coiled on itself, at least two adjacent rectangular portions, preferably according to the invention, form an obtuse angle $\alpha$, i.e. an angle $\alpha$ of less than 180° but more than 90°. Indeed, the portions do not all need to be strictly non-aligned and some consecutive portions may usefully be joined at an angle $\alpha$, for example equal to 180°.

It is of course also possible for each rectangular portion to be joined to at least one other adjacent rectangular portion at an obtuse angle as illustrated in the examples of FIGS. 7 to 10.

Further, the lengths of the rectangular portions forming said one of said at least two opposite faces do not have to be constant. Thus, according to a first alternative illustrated in FIGS. 7 and 9, starting from inner coil $S_{int}$, the outer face $F_{ext}$ of each coil is formed by a series of rectangular portions integral with each other (each junction being symbolised by a dot) with the length of each rectangular portion being constant.

Figure 8:
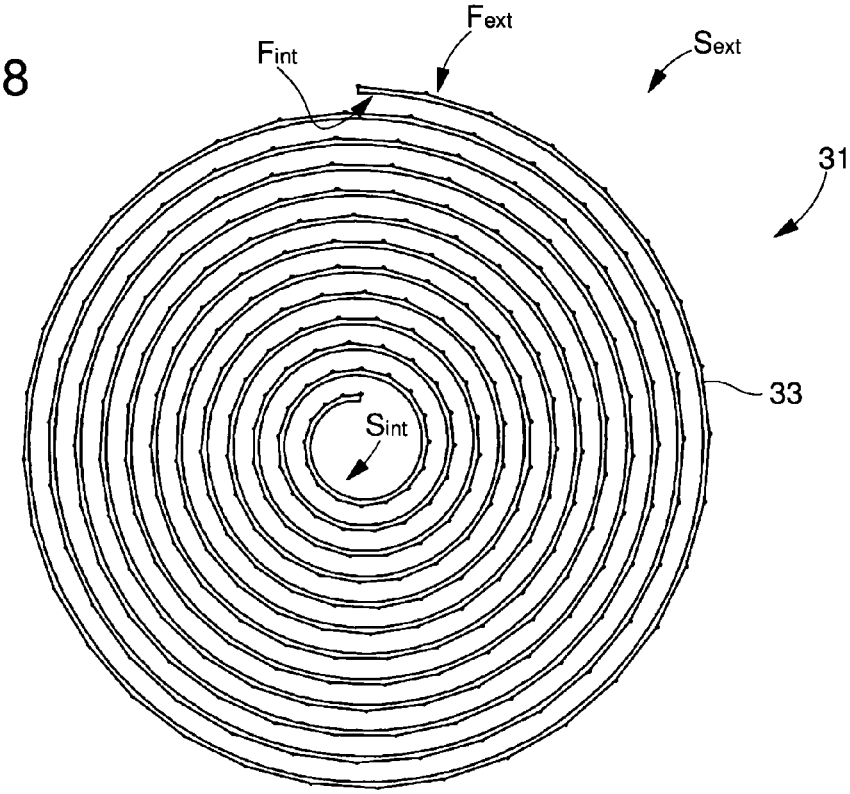
Figure 10:
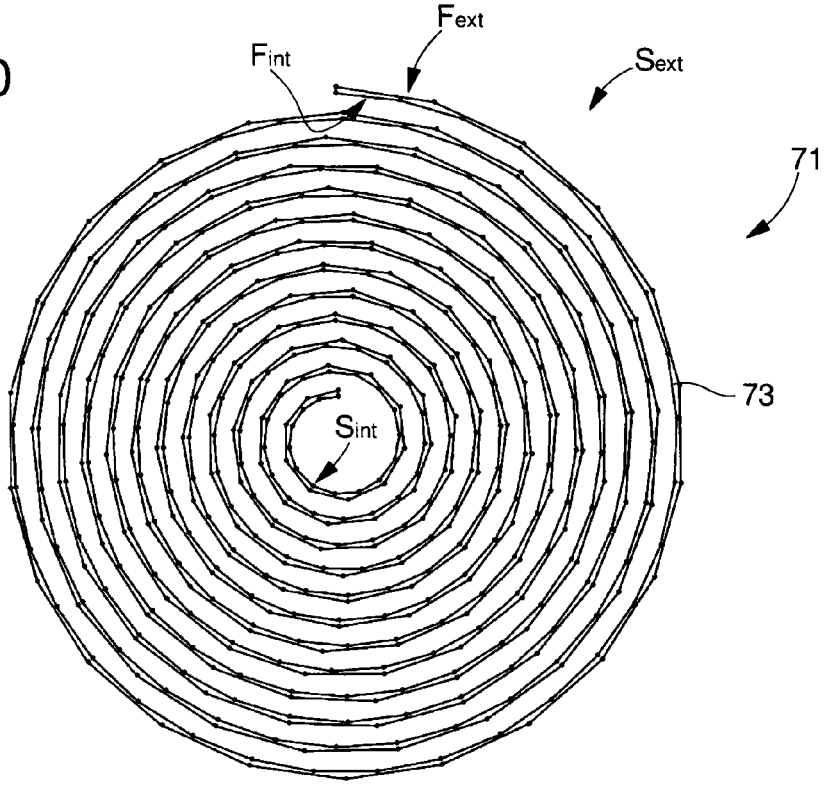

Conversely, according to a second alternative illustrated in FIGS. 8 and 10, starting from inner coil $S_{int}$, the outer face $F_{ext}$ of each coil is formed by a series of rectangular portions integral with each other, with the length of each rectangular portion being non-constant.

Preferably the lengths of the rectangular portions increase continuously from the first rectangular portion of outer face $F_{ext}$ of inner coil $S_{int}$ to the last rectangular portion of outer face $F_{ext}$ of outer coil $S_{ext}$ of balance spring 31, 71.

As seen in FIGS. 7 to 10, since each opposite face $F_{int}$, $F_{ext}$ of each coil is asymmetrical, i.e. not parallel, the geometry of the other face is unrestricted, unlike the first embodiment wherein the opposite faces $F_{int}$, $F_{ext}$ of each prismatic portion are preferably symmetrical, i.e. parallel. Thus, according to a first variant, the other of said at least two opposite faces Fint, $F_{ext}$ is formed by a single spiral-shaped surface like a conventional balance spring.

Figure 7:
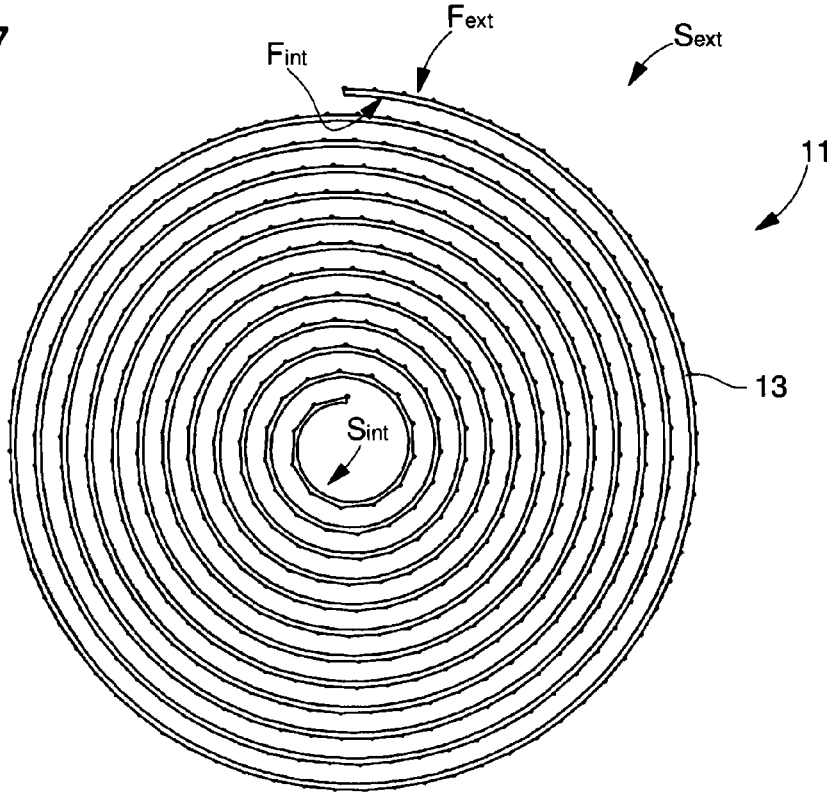
FIGS. 7 to 10 are top views of alternatives or variants of a balance spring according to a second embodiment of the invention.

In the example seen in FIG. 7, balance spring 11 includes an inner face $F_{int}$ formed by a single spiral-shaped surface whereas the outer face $F_{ext}$ thereof is formed by a series of rectangular portions integral with each other (each junction being symbolised by a dot), with the length of each rectangular portion being constant. It is thus understood that, geometrically, the thickness E of strip 13 is not constant.

In the example seen in FIG. 8, balance spring 31 includes an inner face $F_{int}$ formed by a single spiral-shaped surface, whereas the outer face $F_{ext}$ thereof is formed by a series of rectangular portions integral with each other, with the length of each rectangular portion being non-constant. More specifically, the lengths of the rectangular portions increase continuously from the first rectangular portion of outer face $F_{ext}$ of inner coil $S_{int}$ to the last rectangular portion of outer face $F_{ext}$ of outer coil $S_{ext}$ of balance spring 31. It is thus understood that, geometrically, the thickness E of strip 33 is not constant either.

According to a second variant, the other of said at least two opposite faces $F_{int}$, $F_{ext}$ may also be formed by a succession of rectangular portions integral with each other as in the first face.

Figure 9:
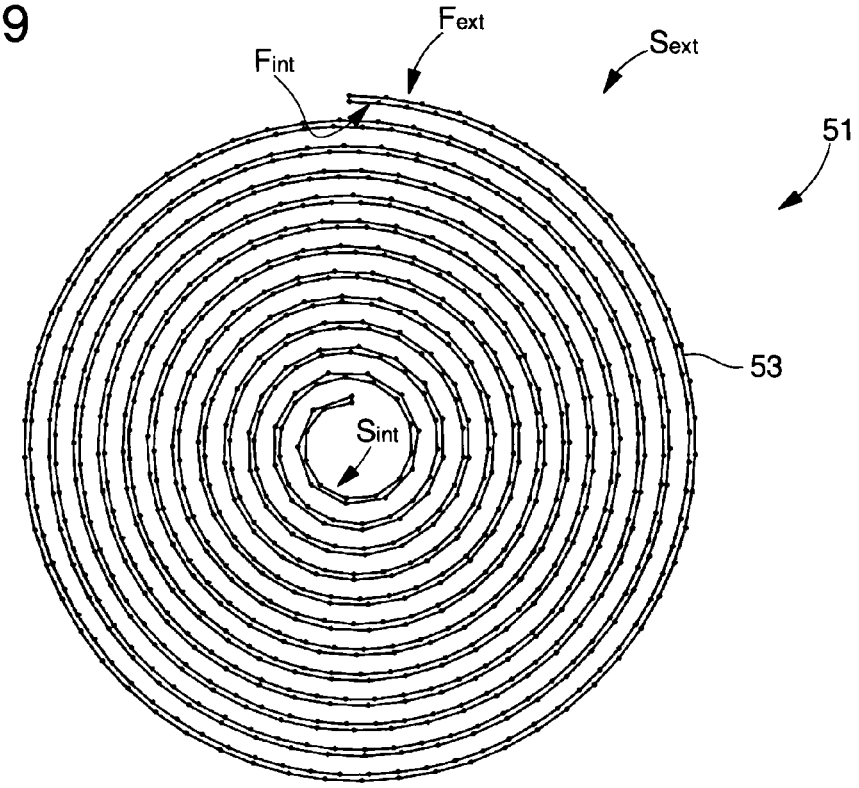

In the example seen in FIG. 9, each inner face $F_{int}$ and outer face $F_{ext}$ of spring 51 is formed by a series of rectangular portions integral with each other (each junction being symbolised by a dot), with the length of each rectangular portion being constant. It is noted that the constant length chosen for each face $F_{int}$, $F_{ext}$ is not identical. Indeed, the constant length of each rectangular portion of inner face $F_{int}$ is smaller than the constant length of each rectangular portion of outer face $F_{ext}$. It is thus understood that, here too, geometrically, the thickness E of strip 53 is not constant.

In the example seen in FIG. 10, each inner face $F_{int}$ and outer face $F_{ext}$ of spring 71 is formed by a series of rectangular portions integral with each other (each junction being symbolised by a dot), with the length of each rectangular portion being non-constant. More specifically, for each face $F_{int}$, $F_{ext}$, the lengths of the rectangular portions increase continuously from the first rectangular portion of inner coil $S_{int}$ to the last rectangular portion of outer coil $S_{ext}$ of spring 71. It is noted that the minimum length chosen for each face $F_{int}$, $F_{ext}$ is not identical. Indeed, the minimum length of the first rectangular portion of inner face $F_{int}$ is smaller than the minimum length of the first rectangular portion of outer face $F_{ext}$. It is thus understood that, here too, geometrically, the thickness E of strip 73 is not constant.

Of course, this invention is not limited to the illustrated example but is capable of various variants and modifications which will appear to those skilled in the art. In particular, the embodiments, variants or alternatives may be combined. Thus, by way of example, one portion of the length of the balance spring could be formed using one of the embodiments, and another portion of the length of the balance spring, by another embodiment.

Figure 4:
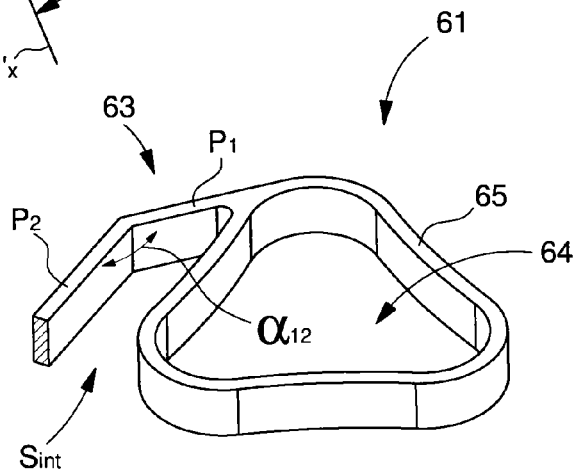
FIG. 4 is a partial perspective view of a collet and of the start of the inner coil of a balance spring according to the invention.

Moreover, the polygonal balance spring 1, 11, 21, 31, 41, 51, 61, 71 may also include an inner coil $S_{int}$ which is integral with a collet arranged to be secured to an arbor. Such an example is illustrated in FIG. 4. FIG. 4 shows a partial view of a balance spring 61 formed by a single strip 63 whose inner coil $S_{int}$ is formed by portions $P_1$, $P_2$, etc. connected to each other at an angle $\alpha_{12}$, the first portion $P_1$ being integral with a collet 65. Collet 65, which is substantially trefoil-shaped, includes a hole 64 intended, for example, to receive a balance staff.

It is also possible to envisage, regardless of the embodiment, that the thickness E of strip 3, 13, 23, 33, 43, 53, 63, 73 of balance spring 1, 11, 21, 31, 41, 51, 61, 71 is modified locally, such as for example, thickened, so as to locally modify, such as for example increase, the rigidity of strip 3, 13, 23, 33, 43, 53, 63, 73.

It is clear from reading the above examples that the balance spring 1, 11, 21, 31, 41, 51, 61, 71 may be in one piece, i.e. the strip 3, 13, 23, 33, 43, 53, 63, 73 is formed with no discontinuity of material. Such a balance spring may be formed of a material including silicon, i.e., for example, single crystal silicon, polycrystalline silicon, doped single crystal silicon, doped polycrystalline silicon, doped or undoped silicon carbide, doped or undoped silicon nitride, doped or undoped silicon oxide such as quartz or silica. Indeed, an anisotropic etch of such materials can be accomplished by wet or dry methods.

What is claimed is:

1. A balance spring for a resonator of a timepiece including:

a solid strip without any recess or hole which is coiled on itself into several coils, wherein at least one part of the strip is formed by a series of prismatic portions integral with each other so as to form a polygonal spring, and wherein at least two adjacent prismatic portions form an angle of more than 90° and less than 180° therebetween.

2. The balance spring according to claim 1, wherein lengths of the prismatic portions forming said balance spring are not constant.

3. The balance spring according to claim 2, wherein the lengths of the prismatic portions decrease continuously from a first prismatic portion of an inner coil to a last prismatic portion of an outer coil of said balance spring.

4. The balance spring according to claim 1, wherein a thickness of the strip is thickened locally in order to increase a rigidity thereof.

5. The balance spring according to claim 1, wherein an inner coil is integral with a collet arranged to be secured to an arbor.

6. The balance spring according to claim 1, wherein the balance spring is in one piece.

7. The balance spring according to claim 1, wherein the balance spring is formed of a material including silicon.

8. A timepiece wherein the timepiece includes at least one balance spring according to claim 1.

9. A balance spring for a resonator of a timepiece including:

a solid strip without any recess or hole which is coiled into several coils, wherein two opposite faces of each coil facing at least one other coil are asymmetrical, and at least one part of one of said two opposite faces is formed by a series of rectangular portions integral with each other so as to form a polygonal spring, and wherein at least two adjacent rectangular portions form an obtuse angle therebetween.

10. The balance spring according to claim 9, wherein lengths of the rectangular portions forming said one of said at least two opposite faces are not constant.

11. The balance spring according to claim 9, wherein the other of said at least two opposite faces is formed by a single spiral-shaped surface.

12. The balance spring according to claim 9, wherein at least one part of the other of said two opposite faces is formed by a series of rectangular portions integral with each other.

13. The balance spring according to claim 12, wherein lengths of the rectangular portions forming the other of said two opposite faces are not constant.

14. The balance spring according to claim 9, wherein lengths of the rectangular portions increase continuously from a first rectangular portion of an inner coil to a last rectangular portion of an outer coil of said spring.

15. The balance spring according to claim 9, wherein a thickness of the strip is thickened locally in order to increase the rigidity thereof.

16. The balance spring according to claim 9, wherein an inner coil is integral with a collet arranged to be secured to an arbor.

17. The balance spring according to claim 9, wherein the balance spring is in one piece.

18. The balance spring according to claim 9, wherein the balance spring is formed of a material including silicon.

19. A timepiece wherein the timepiece includes at least one balance spring according to claim 9.

20. A balance spring for a resonator of a timepiece including:

a solid strip coiled on itself into several coils, wherein at least one part of the strip is formed by a series of prismatic portions integral with each other so as to form a polygonal spring, the lengths of the prismatic portions forming said balance spring are not constant, and the lengths of the prismatic portions decrease continuously from a first prismatic portion of an inner coil to a last prismatic portion of an outer coil of said balance spring.

* * * * *